US005957239A

United States Patent [19]

Marshak

[11] Patent Number: 5,957,239

[45] Date of Patent: Sep. 28, 1999

[54] DECK-RETAINING CLAMP ASSEMBLY

[76] Inventor: Perry Marshak, P.O. Box 843, Amityville, N.Y. 11701

[21] Appl. No.: 08/885,759

[22] Filed: Jun. 27, 1997

[51] Int. Cl.[6] ..... E04G 3/14

[52] U.S. Cl. ..... 182/150; 403/388; 403/398; 411/401

[58] Field of Search ..... 411/400, 401, 411/397, 396, 999, 178, 968; 403/388, 384, 395, 398, 405.1; 182/150

[56] References Cited

U.S. PATENT DOCUMENTS

| | | | |
|---|---|---|---|
| 629,935 | 8/1899 | Sturgis . | |
| 2,422,841 | 6/1947 | McClain | 411/400 X |
| 4,046,480 | 9/1977 | Leensvaart | 403/398 |
| 4,079,487 | 3/1978 | Coop, Sr. | 411/400 X |
| 4,295,765 | 10/1981 | Burke | 411/400 X |
| 4,940,271 | 7/1990 | Steffes | 411/401 X |
| 5,730,248 | 3/1998 | Apostolopoulos . | |

FOREIGN PATENT DOCUMENTS

| | | | |
|---|---|---|---|
| 1190756 | 10/1959 | France | 411/401 |
| 1391174 | 1/1965 | France | 411/401 |
| 2454022 | 11/1980 | France | 411/400 |
| 674845 | 4/1939 | Germany | 411/401 |
| 479090 | 4/1954 | Italy | 411/401 |
| 1236526 | 6/1971 | United Kingdom | 411/401 |

*Primary Examiner*—Peter R. Brown
*Assistant Examiner*—Hanh V. Tran
*Attorney, Agent, or Firm*—Baker & Botts, L.L.P.

[57] ABSTRACT

A deck-retaining clamp assembly secures a corrugated deck panel to a support cable that underlies and supports the deck panel, the deck panel having in a lower web portion an elongated opening that overlies a segment of the support cable and extends transversely of the support cable. A U-bolt engages the cable from below, and a clamp plate is tightened against the upper surface of the deck panel by at least one nut threaded onto one leg of the U-bolt. A handle attached to one of the legs of the U-bolt permits manipulation of the U-bolt to engage it with the support cable. The handle has a grip portion that is shaped and dimensioned such that it cannot pass through the hole in the clamp plate and a shank portion that is movable through the hole in the clamp plate and is of a length such that the U-bolt can be moved down relative to the clamp plate to a position such that the upper end of the U-bolt is at a level below the lowermost extremity of the support cable. Thus, the U-bolt can be engaged with the cable segment by inserting it through the opening in the deck panel laterally adjacent the cable segment, lowering it relative to the clamp plate, displacing it and the clamp plate along the opening in the deck plate, and lifting it by the handle to engage the cable segment in nested relation in the loop portion.

2 Claims, 4 Drawing Sheets

DECK-RETAINING CLAMP ASSEMBLY

BACKGROUND OF THE INVENTION

It is common practice in painting and carrying out maintenance and repair work underneath bridges to install temporary work platforms under the bridge deck. One form of platform consists of horizontal cables attached to transversely opposite supporting columns of the bridge structure or to other available components of the bridge and corrugated decking panels supported by the cables. The decking panels are attached to the cables by clamp assemblies. Generally, each decking panel is attached adjacent each end to the cables that it spans by a clamping assembly. The decking panel has a hole at each end that overlies a segment of the support cable and that accepts a loop portion of either a U-bolt or a J-shaped bolt ("J-bolt"). The loop portion of the U-bolt or J-bolt is engaged under the cable. One leg of the U-or J-bolt is welded to a first clamp plate. The other leg is threaded and free, so that the free end can be maneuvered through the hole and under the cable from above the panel. A second clamp plate with a hole for the threaded leg is then placed on the free end of the bolt, and a nut is installed on the threaded end of the bolt and tightened to draw the loop portion of the U- or J-bolt into engagement with the cable and the two clamp plates down into engagement with portions of the upper surface of the deck adjacent the deck opening.

The previously known clamp assemblies are relatively complicated and costly to produce. They consist of three parts (the bolt and two plates) and require several cutting, drilling and welding steps to make them. Installation requires fishing the U- or J-bolt through the hole in the decking and under the cable and holding the U- or J-bolt/clamping plate unit in place while the other plate and the nut are installed. Removing the clamp plates involves the same steps as installation, in reverse order. In short, installation and removal of the previously known clamp plates are relatively tedious and time-consuming.

The temporary work platforms to which the present invention pertains sometimes include one or more vertical suspension cables, each of which is fastened at its upper end to an element, such as a cross beam, on the underside of the bridge deck and at its lower end to a transverse support cable. It has been previously known to provide for the connection of the lower end of the suspension cable by means of a ring or U-hook that is welded to a base plate, which, in turn, is bolted to the U-bolt of the clamp assembly above the clamp plates of the assembly and under the nuts. The ring or U-hook/base plate is yet another, separate component of the system, thus requiring costly fabrication and yet another installation step.

SUMMARY OF THE INVENTION

One object of the present invention is to provide a clamp assembly for a temporary work platform composed of support cables and decking panels that is of simple construction and that can be fabricated easily and at low cost. Another object of the invention is to provide such a clamp assembly that is easy to install and to remove.

The foregoing objects are attained, in accordance with the present invention, by a deck-retaining clamp assembly that includes a U-bolt having spaced-apart first and second leg portions and a loop portion joining the leg portions, the leg portions being adapted to straddle the cable and the loop portion being adapted to accept the support cable in nested relation and the second leg portion having external threads adjacent its end. A nut is threaded onto the external threads of either one or both of the leg portions in the installed position of the assembly. A clamp plate, which is adapted to engage the upper surface of the lower web of the deck panel along portions bordering the opening in the decking panel, has a first hole that receives the first leg portion and a second hole that receives the second leg portion in the installed position of the assembly. A handle is attached to the end of the first leg portion of the U-bolt, the handle having a grip portion and a shank portion. The grip portion is shaped and dimensioned such that it cannot pass through the first hole in the clamp plate. The shank portion is movable through the first hole in the clamp plate and has a length such that the U-bolt can be moved by manipulation of the handle to a position such that the end of the second leg portion is at a level below the lowermost extremity of the support cable.

Prior to installation of the assembly, the legs of the U-bolt are received through the holes in the clamp plate, and the handle is attached to the U-bolt. The nut may be loosely threaded onto the threaded leg of the U-bolt, where it is at hand, but it need not be. In this state, the clamp plate and U-bolt form a unit; the U-bolt cannot be separated from the clamp plate, even if the nut (or nuts) is not threaded on the leg portion, because the grip portion of the handle cannot pass through the hole in the clamp plate.

When the assembly is to be installed, the loop portion of the U-bolt of the U-bolt/plate unit is inserted into the opening in the decking panel in a position in which the second leg portion of the U-bolt is closer to the cable than the first leg. If the nut is installed on the second leg, it is removed, and the U-bolt is allowed to or manipulated to move downwardly relative to the clamp plate and cable. The U-bolt/clamp plate unit is guided to move the U-bolt through the slot in the deck panel and rest the clamp plate on the surface of the panel, at which point the second leg is at a level below the lowermost extremity of the cable. The U-bolt/clamp plate unit is then slid along the decking panel in a direction to bring the loop portion of the U-bolt directly underneath the cable. The U-bolt is then pulled up, using the handle, to reinsert the leg portions of the U-bolt through the holes in the clamp plate and engage the loop portion with the cable. The nut is then threaded onto the leg portion of the U-bolt and tightened. More simply put, the U-bolt is engaged with the cable segment by inserting it through the opening in the web portion of the deck panel laterally adjacent the cable segment, lowering it relative to the clamp plate, displacing it and the clamp plate along the opening in the deck panel, and lifting it to engage the cable segment in nested relation in the loop portion with the aid of the handle.

Embodiments of the present invention may include the following features, alone or in combination:

- Both leg portions of the U-bolt may have external threads for nuts. An advantage of such a feature is that the U-bolt can be a standard, off-the-shelf U-bolt. A nut can be used on either or both legs, the use of two nuts, however, being preferred.
- The shank of the handle is releasably attached to the first leg portion, such as by internal threads on the first leg portion and external threads on the shank of the handle. This feature eliminates welding and allows the handle (and an optional nut on the first leg portion) to be easily installed on the clamp plate after the U-bolt is inserted through the holes in the clamp plate. The handle can also be removed after the assembly is installed.
- The shank of the handle may be integral with the first leg portion of the U-bolt. Similarly, the grip portion may be separate from or integral with the shank portion. A unitary U-bolt/handle may offer economies of manufacture.

The grip portion of the handle may be a ring that is adapted to receive a suspension cable, whereby the clamp assembly is adapted to connect the suspension cable to the support cable. With such an arrangement, the handle has a dual function—first, it provides for manipulation of the U-bolt; second, it adapts the assembly for use as a connector between the lower end of a suspension cable and a support cable. In an advantageous arrangement, the first leg portion and the shank of the handle are unitary and the ring is welded to the shank portion.

The clamp assembly is of simple construction, thus making it easy and inexpensive to make. It has a single clamp plate, which is made by cutting it to size from plate stock and drilling two holes. A standard, off-the-shelf U-bolt can be adapted for the clamp assembly by drilling and tapping a hole in one of the legs. The handle can be of various configurations and produced in various ways, such as: shaping an integral grip portion and forming threads on a metal rod; molding a handle from plastic; securing a crossbar or knob to a length of threaded rod. When the handle of the U-bolt is integral with the U-bolt, an integral (unitary) grip portion can be formed by bending the end of the shank portion into a ring shape after the handle is inserted through one of the holes in the clamp plate, or a separate grip member can be attached.

A particular advantage of the clamp assembly of the present invention results from the fact that, except for the nut (or nuts), the clamp, U-bolt, and handle are interconnected when the assembly is installed. The assembly can, accordingly, be easily and quickly maneuvered into place to engage the U-bolt with the cable by manipulation of the grip portion of the handle with one hand and the nut or nuts started onto the U-bolt with the other hand.

Except for the form of clamp assembly in which a ring is permanently and strongly connected to the U-bolt to receive a suspension cable, it will generally be preferable for the handles to be detachable from the U-bolts so that they can be removed after the assembly is installed and leave the upper surface of the deck free of projections.

For a better understanding of the invention, reference may be made to the following description of exemplary embodiments, taken in conjunction with the accompany drawings.

DESCRIPTION OF THE EMBODIMENTS

Figure 1:
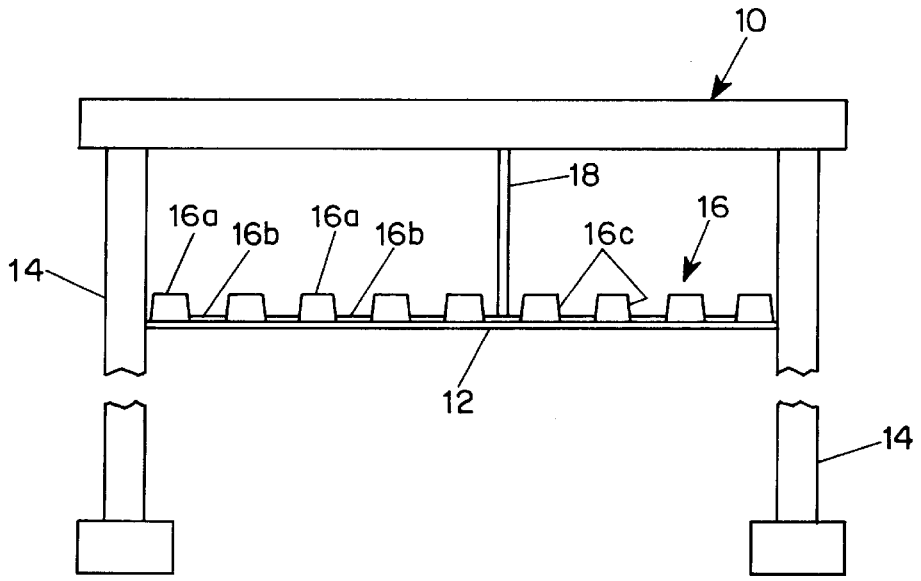
FIG. 1 is a schematic end elevational view of a bridge having a temporary work platform installed under the bridge deck.
Figure 2:
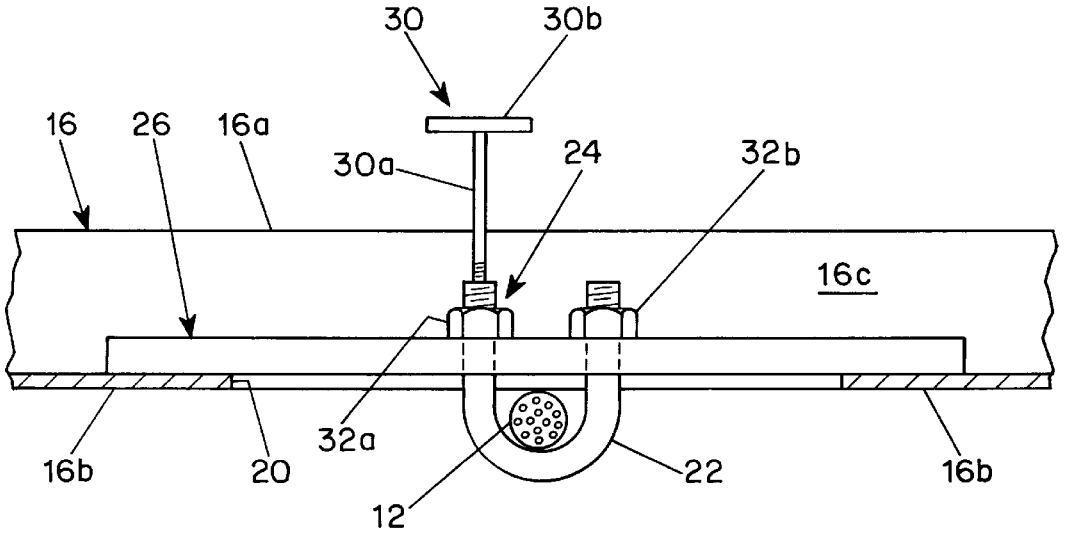
FIG. 2 is a side cross-sectional view taken lengthwise of a deck panel (see lines 2—2 of FIG. 4) and shows one embodiment of a clamp assembly in side elevation in the installed condition.

Referring to FIG. 1, a temporary work platform is erected under the deck 10 of a bridge by rigging horizontal support cables 12 transversely of the bridge between columns 14 and placing corrugated deck panels 16 side by side on the support cables. The deck panels, which are shown schematically and far out of scale, may be of the type that are commonly used as construction forms for a reinforced concrete bridge deck and consist of upper web portions 16*a* and lower web portions 16*b* joined by oblique rib portions 16*c*. One or more vertical suspension cables 18 are secured at their upper ends to the underside of the bridge deck and at their lower ends to each of the support cables 12 of the work platform.

Each of the deck panels 16 is fastened adjacent each of its ends to the support cables 12 by a clamp assembly, one embodiment 24 of which is shown in FIGS. 2 to 5. Each deck panel 16 is prepared for use in the platform by cutting an elongated slot 20 near each end in one of the lower web portions 16*b*, each slot being located and being long enough to overlie a support cable 12 and to extend longitudinally of the panel a sufficient distance away from the cable to permit a U-bolt 22 of the clamp assembly 24 to be inserted from above the deck panel through the slot on one side or the other of the support cable 12.

The clamp assembly 24 has a metal clamp plate 26 that overlies the slot and portions of the lower web portion adjacent the slot and has two holes 26*a* and 26*b*, one for each of the leg portions 22*a* and 22*b* of the U-bolt 22. If desired, the U-bolt can be prepared for use in the clamp assembly from a standard, off-the-shelf U-bolt by drilling and tapping a hole 22*c* in one of the leg portions 22*a* (see FIG. 4) by which a handle 30 is attached to the U-bolt. Alternatively, a specially made U-bolt with a drilled and tapped hole in one leg can be used in the embodiment of FIGS. 2 to 5. The handle 30 has a shank portion 30*a*, which is externally threaded at its lower end, and a grip portion 30*b* at its upper end. The design of the handle can vary widely, the only requirements being (1) that the grip portion be of a size and shape such that it cannot pass through the hole 26*a* in the clamp plate 26, lest it become possible for the U-bolt to fall to the ground if the user lets go of the handle when the clamp assembly is being installed, and (2) that the shank be able to pass freely through the hole 26*a* and be of a length such that when the U-bolt is inserted into the slot 20 in the deck panel, the U-bolt can be lowered far enough to place the upper end of the leg portion 20*b* below the level of the lowermost extremity of the cable 12.

Figure 3:
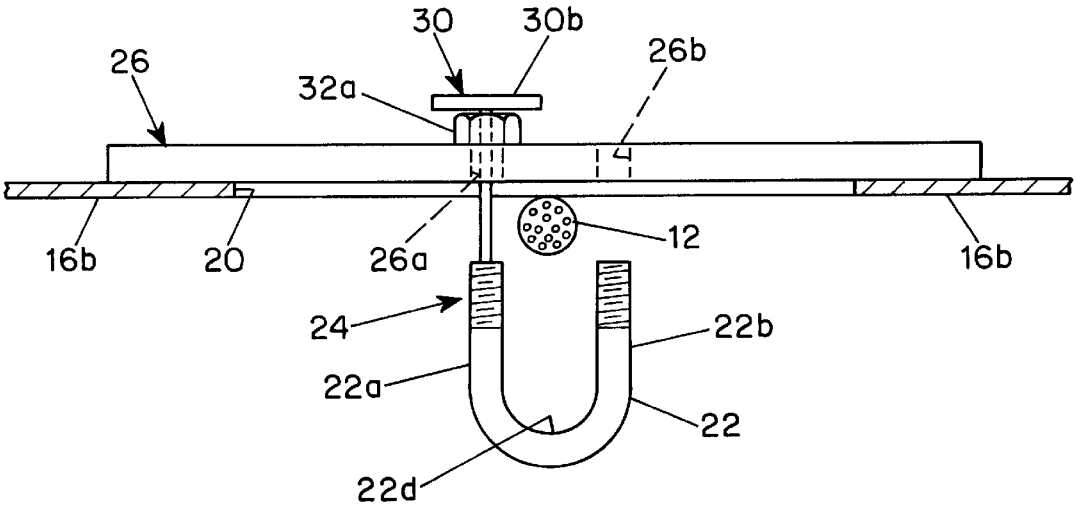
FIG. 3 is a view similar to FIG. 2 but shows the clamp assembly partly installed.
Figure 5:
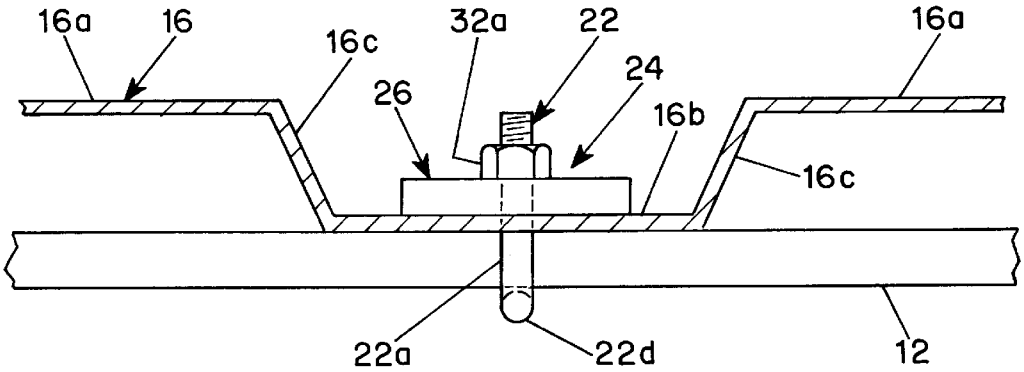
FIG. 5 is an end cross-sectional view taken along the lines 5—5 of FIG. 4.
Figure 4:
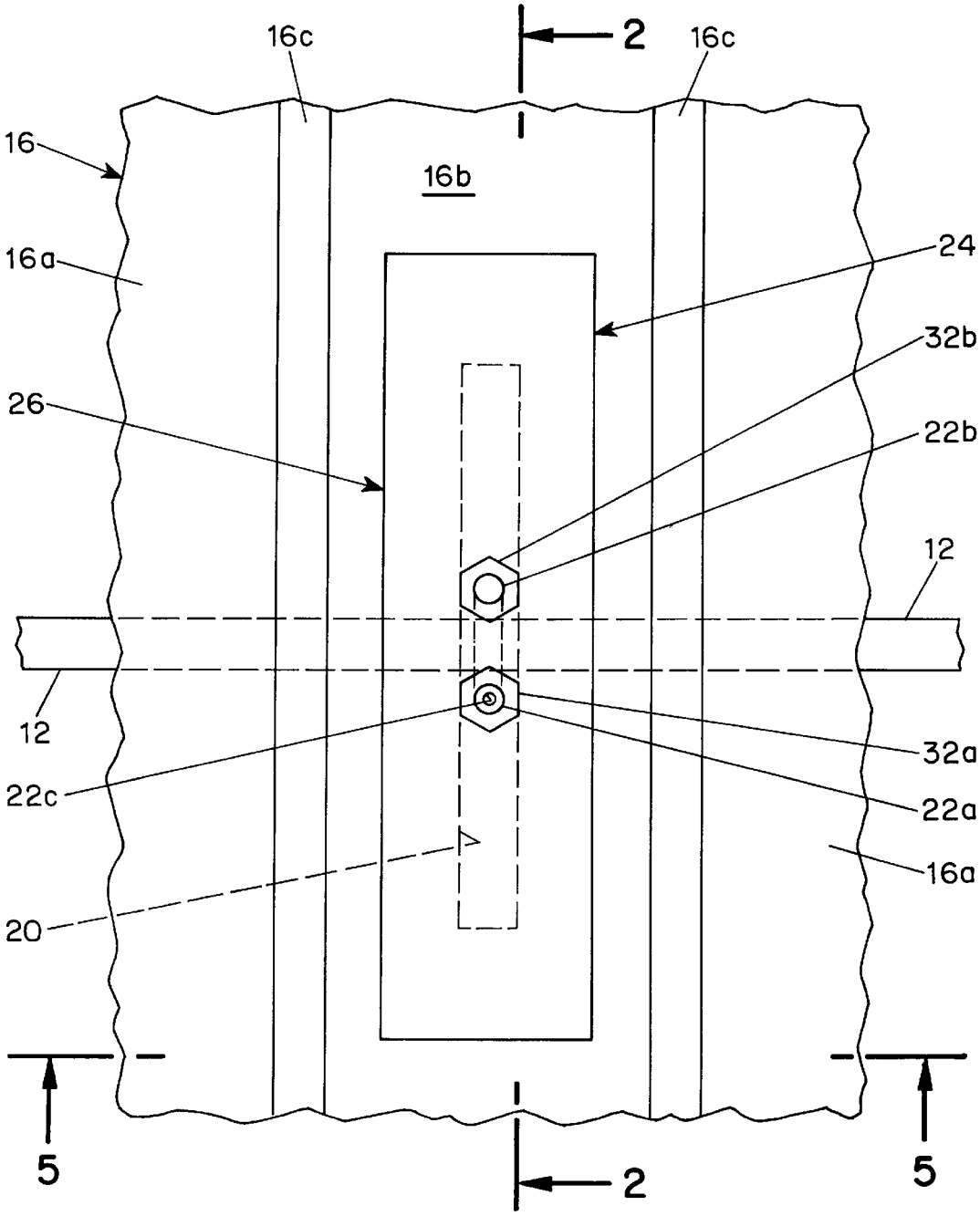
FIG. 4 is a top plan view of the assembly of FIGS. 2 and 3 as installed and with the handle removed.

The clamp assembly 24 is made ready for installation by inserting the leg portions 22*a* and 22*b* of the U-bolt 22 through the holes 26*a* and 26*b* in the clamp plate 26, placing the nut 32*a* on the shank portion 30*a* of the handle 30, and threading the handle into the hole 22*c* to firmly, but releasably, connect the handle to the U-bolt 22. The clamp plate is grasped and placed over the slot 20 in the deck panel with the U-bolt positioned to one side of the cable 12 and oriented such that it can pass through the slot with the leg portion 22*b* nearer to the cable than the leg portion 22*a*. The clamp assembly is then put down on the top of the panel, thus inserting the U-bolt through the slot in the deck panel. These steps can be visualized from FIG. 3; to attain the position shown in FIG. 3, the assembly was lowered onto the deck panel to arrive at a position to the left of the illustrated position and then moved to the right, thus to locate the loop portion 22*d* of the U-bolt 22 vertically below the cable 12 as shown in FIG. 3. Next, the user grasps the grip portion 30*b* of the handle 30 and pulls the handle up to insert the leg portions of the U-bolt through the holes of the deck panel and engage the loop portion of the U-bolt with the cable. While holding the handle up, the user threads the nuts 32*a* and 32*b* onto the leg portions of the U-bolt and tightens them tightly with a wrench to clamp the deck plate firmly between the cable 12 and the clamp plate 26. The handle can be removed, which is preferred so as to not have it project above the plane of the upper web portions of the deck, or left installed, as desired.

Although it is desirable to install nuts on both legs of the U-bolt, it is possible to omit either one of the nuts. It is also possible to make the deck plate shorter than the length of the slot, inasmuch as the clamping action occurs predominately immediately above the cable along the portions of the deck plate laterally of the slot. A sheet of high friction material, such as a rubber pad, can be inserted between the panel and the clamp plate to increase friction.

Figure 6:
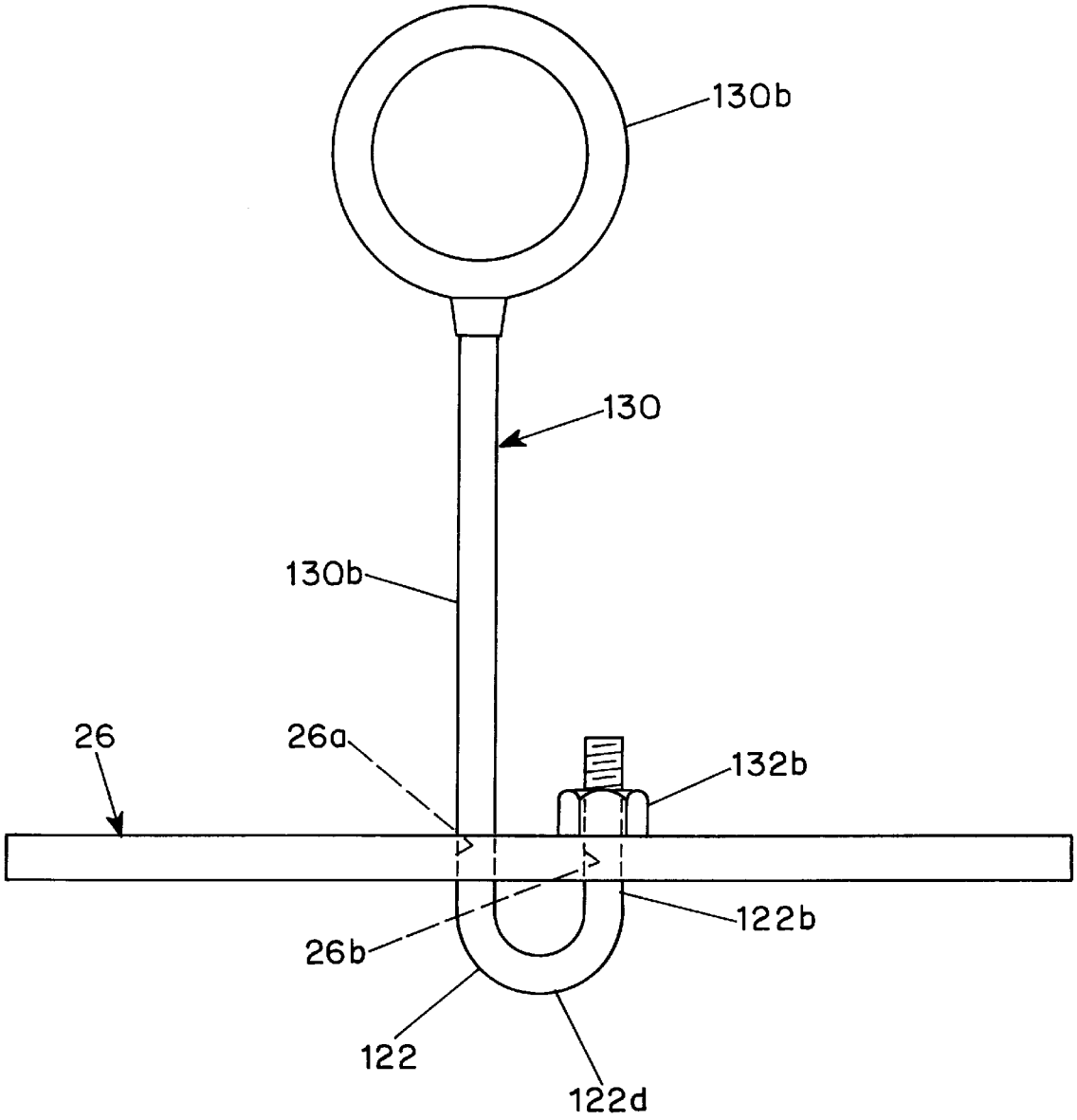
FIG. 6 is a side elevational view of another embodiment of the invention.

The embodiment shown in FIG. 6 uses the same clamp plate 26 and a special U-bolt 122, which has a handle 130 that is unitary with the U-bolt. The handle 130 functions not only to enable manipulation of the assembly when it is installed, as described above, but as a fastening point for the lower end of the vertical suspension cable 18 (see FIG. 1). To this end, the grip portion is in the form of a ring 130*b* that is fastened, such as by welding, to the upper end of the shank portion 130*a*. The ring 130*b* is fastened to the shank portion 130*b* after the shank portion is inserted through one of the holes in the clamp plate. Only one leg portion 122*b* of the U-bolt 130 is threaded, and only one nut 132*b* is used. The manner of installing the embodiment of FIG. 6 is self-evident, particularly in the light of the description above of installing the first embodiment. The unitary U-bolt/handle of FIG. 6 carries part of the load on the support cable 12, the support cable being firmly nested in and captured by the loop portion 122*d*.

The ring can, of course, be formed integrally with the shank portion by bending the rod stock from which the U-bolt/handle is formed into a ring after the shank portion is inserted through the hole in the clamp plate. The free end of the integral ring can be welded to the shank for greater strength.

I claim:

1. In a work platform in which a deck-retaining clamp assembly secures a corrugated deck panel to a support cable that underlies and supports the deck panel, the deck panel having in a lower web portion an elongated opening that overlies a segment of the support cable and has a longer dimension that extends transversely of the support cable and a shorter dimension that is aligned with the cable, the improvement wherein the clamp assembly comprises a U-bolt having spaced-apart first and second leg portions of equal lengths and a loop portion joining the leg portions, the leg portions being adapted to straddle the cable and the loop portion being adapted to accept the support cable in nested relation and the first and second leg portions having external threads adjacent their ends;

a nut threaded onto the external threads of each of the leg portions in the installed position of the assembly;

a clamp plate having a width that is substantially greater than the smaller dimension of the opening and a length substantially greater than the longer dimension of the opening so as to be adapted to engage the upper surface of the lower web of the deck panel along portions of the lower web bordering the entire perimeter of the opening and having a first hole receiving the first leg portion and a second hole receiving the second leg portion in the installed position of the assembly; and a handle releasably attached to the end of the first leg portion of the U-bolt, the handle having a grip portion and a shank portion, the grip portion being shaped and dimensioned such that it cannot pass through the first hole in the clamp plate and the shank portion being movable through the first hole in the clamp plate and having a length such that the U-bolt can be moved by manipulation of the handle to a position such that the end of the second leg portion is below the lowermost extremity of the support cable, whereby the U-bolt can be engaged with the cable segment by inserting it through the opening in the web portion of the deck panel laterally adjacent the cable segment, lowering it relative to the clamp plate, displacing it along the opening in the deck plate, and lifting it to engage the cable segment in nested relation in the loop portion.

2. The improvement according to claim 1 wherein the handle is attached to the first leg portion by internal threads on the first leg portion and external threads on the shank of the handle.

* * * * *